US006940439B2

(12) United States Patent
Shieh et al.

(10) Patent No.: US 6,940,439 B2
(45) Date of Patent: Sep. 6, 2005

(54) MULTI-TRACK SPEECH SYNTHESIZER

(75) Inventors: Wuu-Trong Shieh, Hsinchu (TW); Ying-Pin Ho, Hsinchu (TW)

(73) Assignee: Elan Microelectronics Corporation, Hsinchu (TW)

( * ) Notice: Subject to any disclaimer, the term of this patent is extended or adjusted under 35 U.S.C. 154(b) by 778 days.

(21) Appl. No.: 10/006,126

(22) Filed: Dec. 10, 2001

(65) Prior Publication Data

US 2002/0111807 A1 Aug. 15, 2002

(30) Foreign Application Priority Data

Dec. 20, 2000 (TW) ..... 89127458 A

(51) Int. Cl.[7] ..... H03M 1/66

(52) U.S. Cl. ..... 341/144; 341/136

(58) Field of Search ..... 341/144, 145, 341/136, 146, 135

(56) References Cited

U.S. PATENT DOCUMENTS 5,631,647 A * 5/1997 Huang ..... 341/136

* cited by examiner

*Primary Examiner*—Peguy Jeanpierre
*Assistant Examiner*—Joseph Lauture
(74) *Attorney, Agent, or Firm*—Rosenberg, Klein & Lee

(57) ABSTRACT

A multi-track speech synthesizer comprises a plurality of volume control units, a plurality of signal transform units, a plurality of current switch units, a comparison unit and a current output unit. Each current switch units includes a pair of complementary outputs to send out a current with its zero point at zero, and the output terminals of the current switch units are directly coupled together to form two connected output terminals. The comparison unit compares the voltages of the connected output terminals and then sends out a control signal to control the current output unit. Under the control of the control signal, the current output unit sends out a current of push-pull type with direct connection. Due to the zero point of the current from the current switch unit at 0, the direct current component by the direct connection will not be accumulated, thereby reducing the power consumption in comparison with traditional DAC multi-track speech synthesizers with (wire OR) direct connection.

6 Claims, 11 Drawing Sheets

MULTI-TRACK SPEECH SYNTHESIZER

FIELD OF THE INVENTION

The present invention relates generally to a multi-track speech synthesizer, and more particularly, to a multi-track speech synthesizer utilizing current switch and push-pull output technique.

BACKGROUND OF THE INVENTION

For consumer electronic products, digital sound effect is an important function. FIG. 1 shows the functional block diagram of a traditional multi-track speech synthesizer utilizing digital to analog converter (DAC). A DAC speech synthesizer 100 comprises three basic units, volume control unit 101, signal transform unit 102 and drive unit 103, and a plurality of signal transform units 102 can be connected directly to form a multi-track speech synthesizer.

Two volume control units 101 accept control signals $V_{ctrl1}$ and $V_{ctrl2}$ respectively and produce control biases $V_{bias1}$ and $V_{bias2}$. Two signal transform units 102 accept control biases $V_{bias1}$ and $V_{bias2}$ and pulse code modulation (PCM) signals $PCM_1$ and $PCM_2$ respectively and transform them to analog speech signal $I_{vo1}$ and $I_{vo2}$. The drive unit 103 receives the current from the directly coupled analog speech signals $I_{vo1}$ and $I_{vo2}$ and amplifies the coupled current $I_{vo}$ to drive the speaker 104. FIG. 2A is the waveform of a 7-bits sinusoidal PCM signal, and FIG. 2B is the waveform of the analog speech signal $I_{vo}$ after the PCM signal shown in FIG. 2A is processed by the signal transform unit 102 shown is FIG. 1. Assuming that the zero point of each analog speech signal $I_{vo}$ is 1.5 mA, the direct current component increases due to the accumulation resulted from the directly coupled signals, which increases the power consumption. For applications of portable electronic products whose power supply is battery, such large power consumption should be avoided. Moreover, to prevent the transistor 105 within the drive unit 103 from saturated to result in a speech distortion, a bypass resistor 106 is inserted thereof, which further results in the speech distortion more seriously.

SUMMARY OF THE INVENTION

To resolve the above problems, the present invention is therefore directed to a multi-track speech synthesizer with drive current having no direct current component to reduce power consumption.

According to the present invention, a multi-track speech synthesizer comprises a plurality of signal transform units, a plurality of current switch units, a comparison unit and a current output unit. The signal transform units accept and transform a series of digital speech codes to be an analog speech signal with its negative half-cycles inverted respectively. Each current switch unit is connected to a signal transform unit respectively, and receives the analog speech signal from the signal transform unit. Each current switch unit has a first output terminal and a second output terminal to have the current of the positive half-cycle of the analog speech signal flowing out from the first output terminal and flowing in from the second output terminal and the current of the negative half-cycle of the analog speech signal flowing out from the second output terminal and flowing in from the first output terminal. The first output terminals of each current switch unit are connected to each other and forms a first connected output terminal. The second output terminals of each current switch unit are connected to each other and forms a second connected output terminal. The voltages from the first and second connected output terminals are compared by the comparison unit so as to send out a control signal. The current output unit accepts the currents from the first and second connected output terminals and sends out the currents from a first drive terminal or a second drive terminal depending on the control signal from the comparison unit.

The multi-track speech synthesizer according to the present invention uses the current switch technique to process the positive and negative half-cycles of each speech signal separately such that the currents have their zero point to be 0 and are directly coupled, the comparison unit to compare the voltages of the directly coupled signals to send out the control signal to control the current output unit, and the current output unit to send out the drive current by push-pull output technique to drive a speaker. Since the drive current has no direct current component, the power consumption is reduced.

BRIEF DESCRIPTION OF THE DRAWINGS

For a better understanding of the present invention, reference may be had to the following description of exemplary embodiments thereof, considered in conjunction with the accompanying drawings, in which:

FIG. 5 shows the waveforms of the output and input of the signal transform unit shown in FIG. 4, in which FIG. 5(A) is the waveform of a PCM signal and FIG. 5(B) is the waveform of the output current;

FIG. 7(B) is the output waveform from the output terminal;

FIG. 9 shows the switch circuit diagrams applied to the present invention, in which FIG. 9(A) is the current output type switch and FIG. 9(B) is the current input type switch;

DESCRIPTION OF PREFERRED EMBODIMENTS

Figure 3:
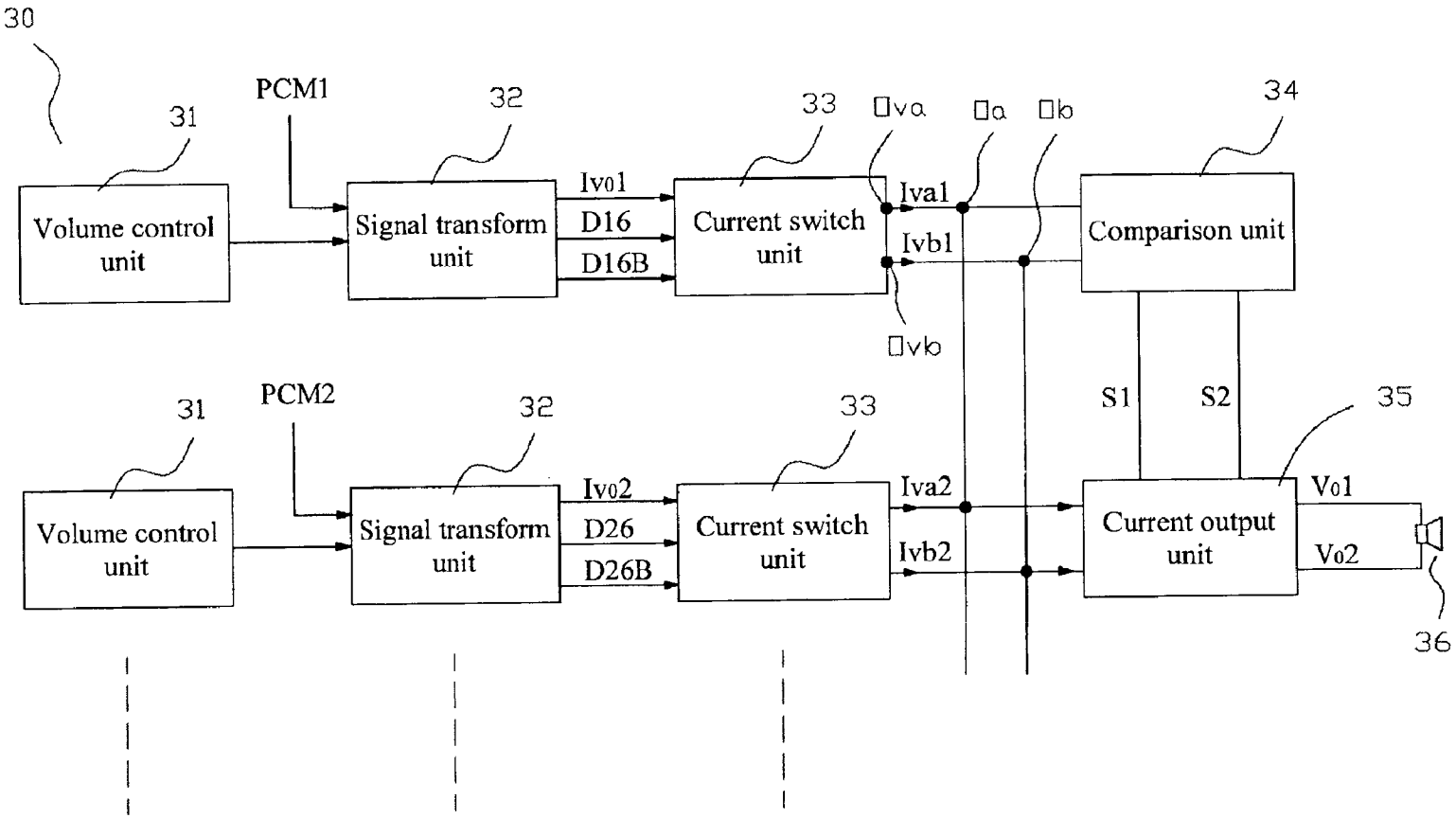
FIG. 3 is the functional block diagram of a multi-track speech synthesizer according to the present invention.

FIG. 3 is the functional block diagram of a multi-track speech synthesizer according to the present invention. A speech synthesizer 30 comprises a plurality of volume control units 31, a plurality of signal transform units 32, a plurality of current switch units 33, a comparison unit 34 and a current output unit 35.

Figure 1:
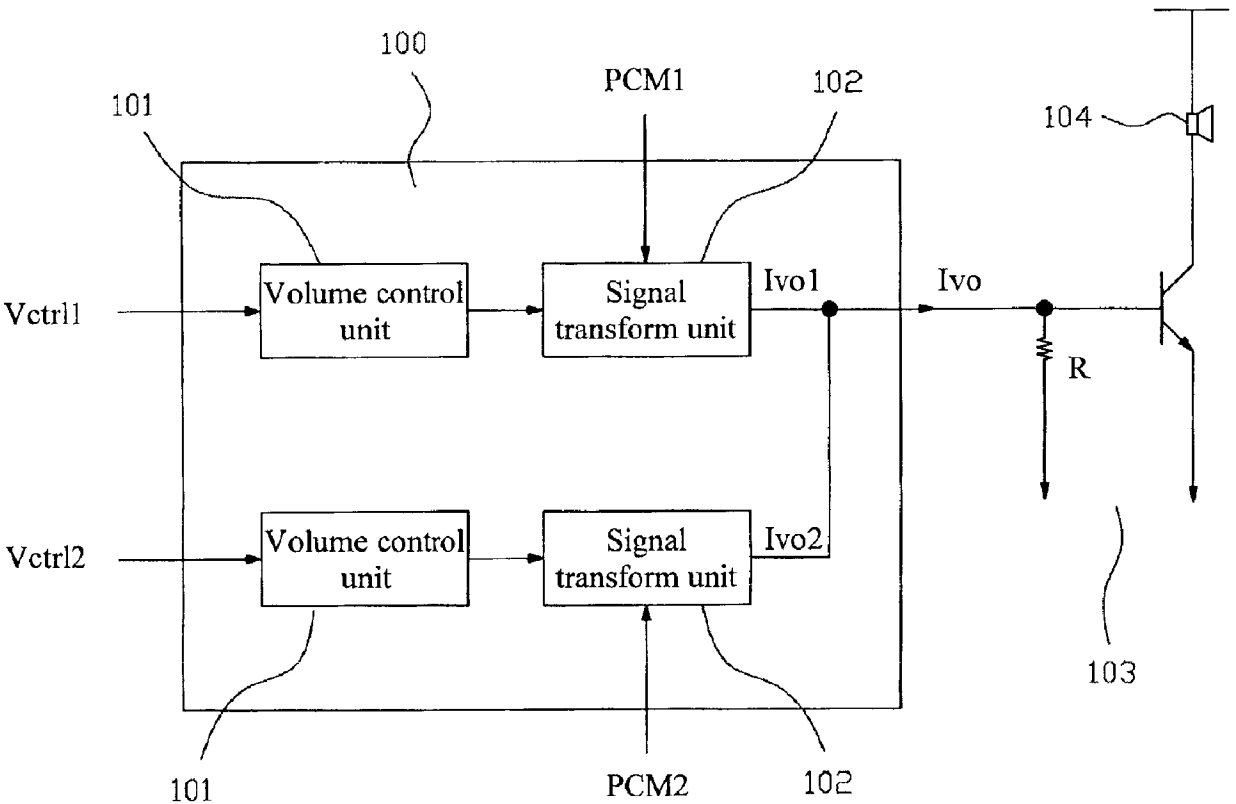
Fig. 1 (Prior Art)
FIG. 1 shows the functional block diagram of a traditional DAC speech synthesizer.
Figure 2:
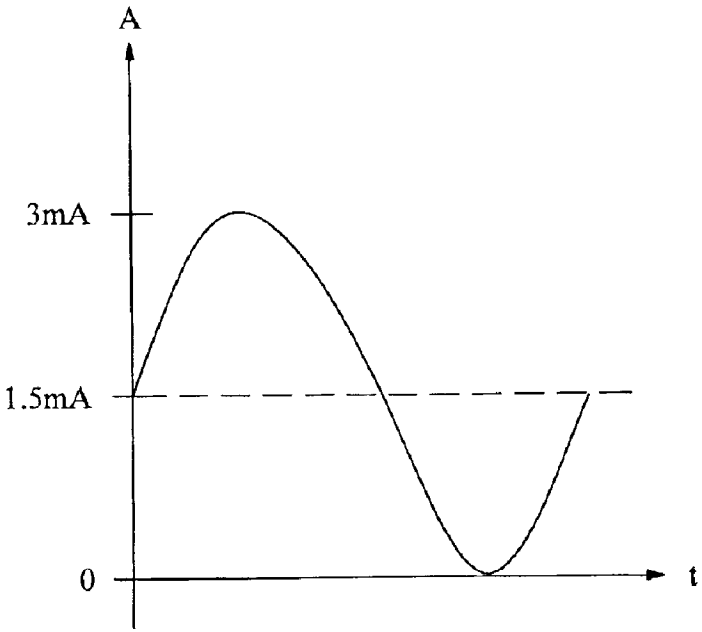
FIG. 2(A) is the waveform of a 7-bits sinusoidal PCM signal.
FIG. 2(B) is the waveform of the analog speech signal after the PCM signal shown in FIG. 2(A) is processed by the signal transform unit 102 shown is FIG. 1.
Figure 2:
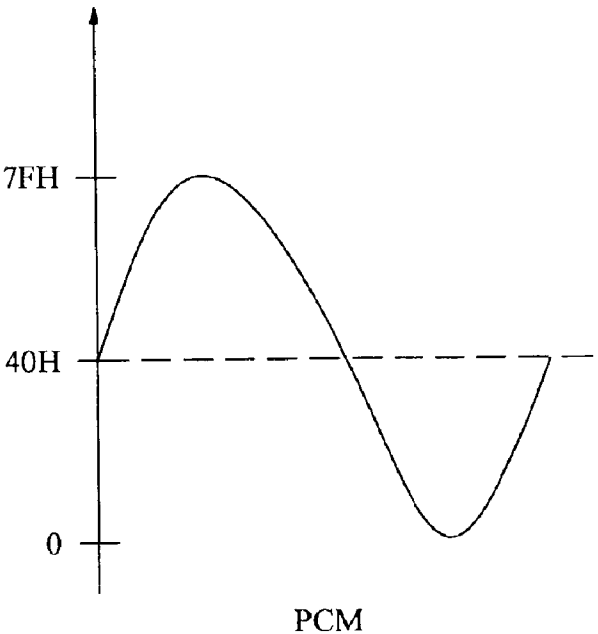
Fig. 2 (A) (Prior Art)

The volume control unit 31 receives a control signal $V_{ctrl}$ and produces a control bias $V_{bias}$, whose function is same as the volume control unit 101 of the traditional DAC speech synthesizer shown in FIG. 1. The control bias $V_{bias}$ is sent to the signal transform unit 32 for volume control. Each signal transform unit 32 receives a series of digital speech signals ($PCM_1$, $PCM_2$, . . . ) respectively and transforms them to be positive valued analog speech currents $I_{vo1}$, $I_{vo2}$, . . . for output, and sends out the most significant bit (MSB) signal and the inverted signal of the digital speech signal, for example, D16 and D16B, D26 and D26B, . . . of 7-bits digital speech signals $PCM_1$, $PCM_2$, . . . respectively. The current switch unit 33 is used to accept the analog speech currents $I_{vo1}$, $I_{vo2}$, . . . and the MSB signals D16 and D16B, D26 and D26B, . . . , and convert the analog speech currents $I_{vo1}$, $I_{vo2}$, . . . to be analog speech currents $I_{va1}$ and $I_{vb1}$, $I_{va2}$ and $I_{vb2}$, . . . that vary in-between positive and negative value and have a zero point of 0 and are sent out from first and second output terminals $O_{va}$ and $O_{vb}$. As shown in FIG. 3, the first output terminals $O_{va}$ of each current switch unit 33 are connected together to form a first connected output terminal $O_a$, and the second output terminals $O_{vb}$ of each current switch unit are also connected together to form a second connected output terminal $O_b$. The comparison unit 34 produces control signals $S_1$ and $S_2$ depending on the voltages of the first and second connected output terminals. The current output unit 35 accepts the currents from the first and second connected output terminals and produces a drive current under control of the control signals $S_1$ and $S_2$ and sent to a speaker 36 from first drive terminals $V_{o1}$ and $V_{o2}$.

Figure 4:
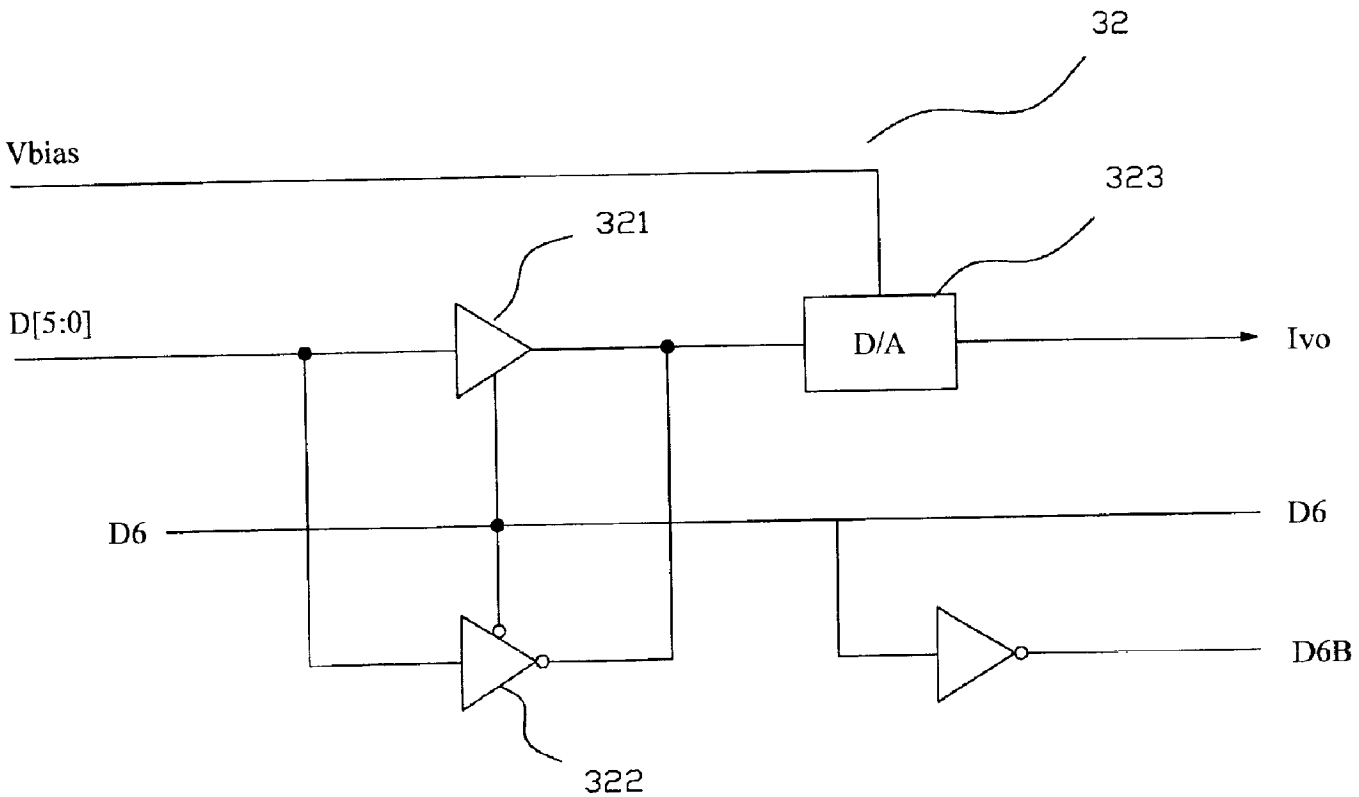
FIG. 4 is a circuit diagram for the signal transform unit shown in FIG. 3.
Figure 5:
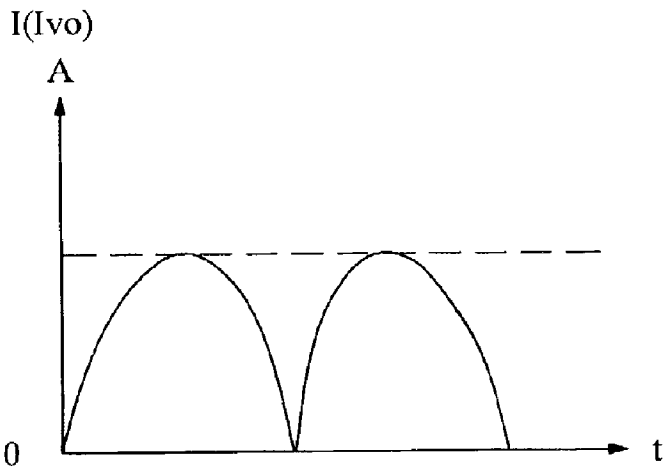
Figure 5:
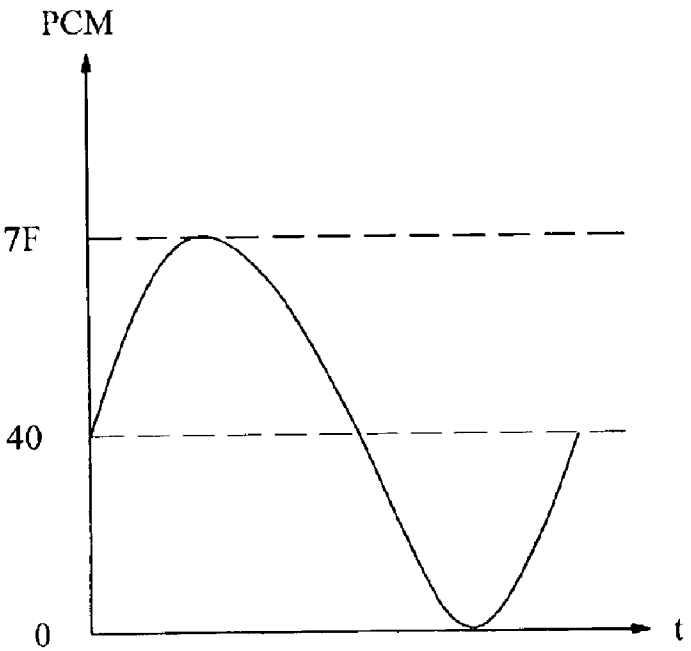

FIG. 4 shows a circuit diagram for the signal transform unit 32 of the speech synthesizer according to the present invention. The signal transform unit 32 receives the control bias $V_{bias}$ and a series of PCM digital speech signal such as 7-bits signal D[6:0], and then converts the speech signal to a positive valued analog speech signal $I_{vo}$. The signal transform unit 32 includes a switched buffer 321 and a switched inverter buffer 322 connected in parallel, and an DAC 323. Both the switched buffer 321 and switched inverter buffer 322 receive the lower bits data D[5:0] of the PCM digital speech signal and are controlled by the MSB signal (D6), that is when MSB=1, the switched buffer 321 is enabled and the lower bits data D[5:0] is sent to the DAC 323; in the opposite situation, when MSB=0, the switched inverter buffer 322 is enabled and the lower bits data D[5:0] is inverted and sent to the DAC 323. The DAC 323 converts the lower bits data D[5:0] and its inverse DB[5:0] that sent by the switched buffer 321 and by the switched inverter buffer 322 to be the analog speech signal $I_{vo}$. As shown in FIG. 5(A), the zero point of a sinusoid PCM speech signal is 40H, so the most significant bit MSB of the front half-cycle is 1 and the most significant bit of the rear half-cycle is 0. Therefore the signal transform unit 32 converts the PCM digital speech signal and produces the analog speech signal $I_{vo}$ as shown in FIG. 5(B).

Figure 6:
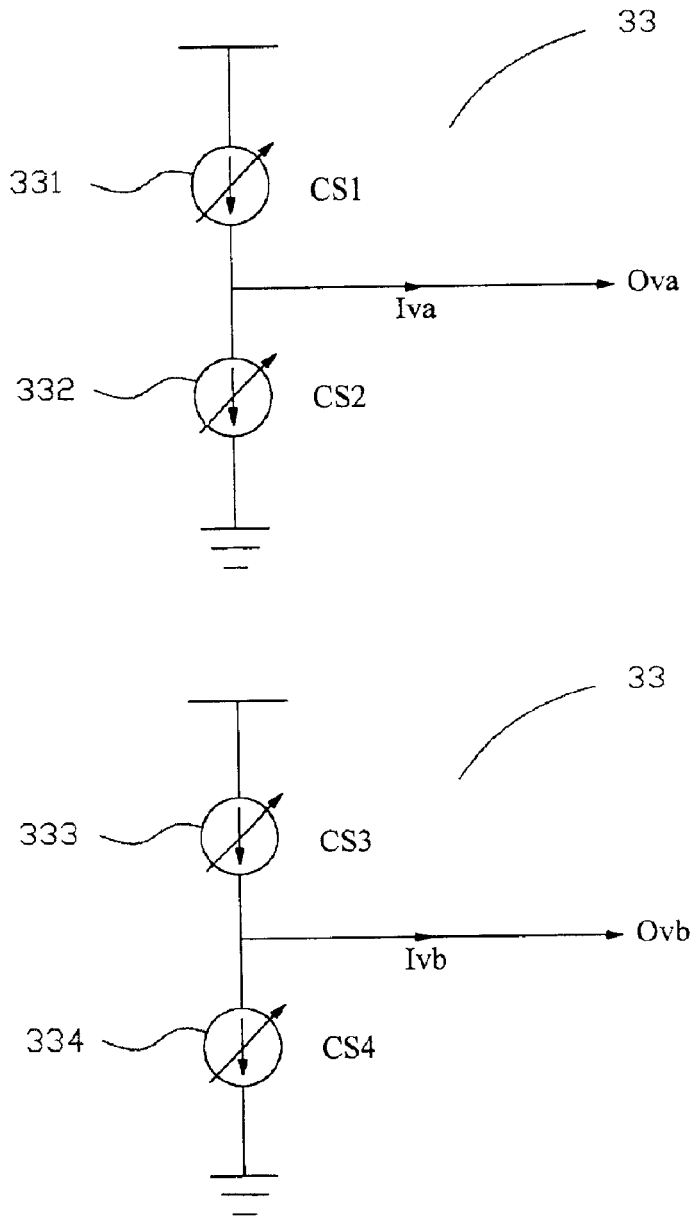
FIG. 6 is a control diagram for the current switch unit shown in FIG. 3.
Figure 7:
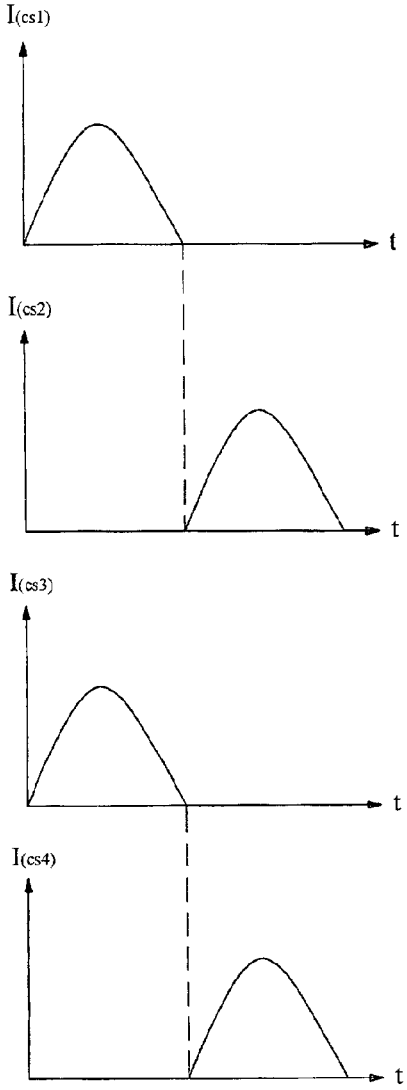
FIG. 7 shows the related waveforms of the current switch unit shown in FIG. 6, in which FIG. 7(A) are the output waveforms of each current source
Figure 7:
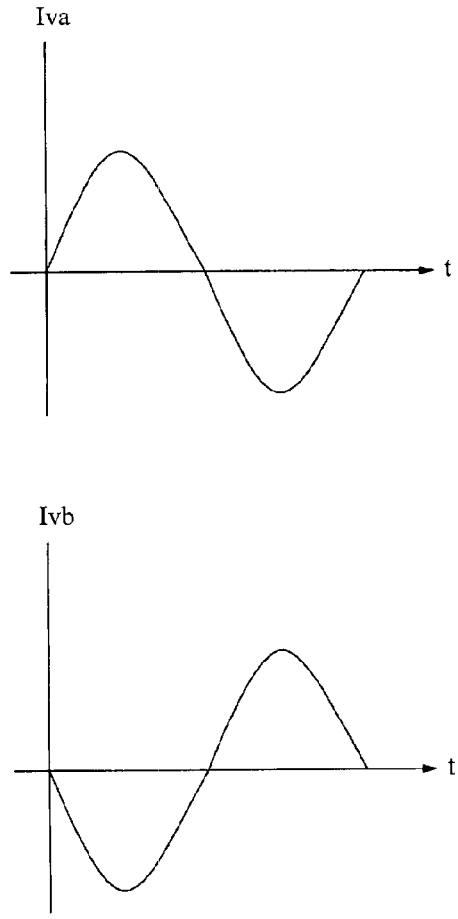

A control diagram for the current switch unit 33 is shown in FIG. 6. The current switch unit 33 includes four switched current sources 331, 332, 333 and 334, among which the current sources 331 and 332 are connected in serial and their connected node is the first output terminal $O_{va}$, and the current sources 333 and 334 are connected in serial and their connected node is the second output terminal $O_{vb}$. The control model of the current switch unit 33 can be separated into two states, positive half-cycle state (D6=1 and D6B=0) and negative half-cycle state (D6=0 and D6B=1). When in the positive half-cycle state, the first and fourth switched current sources 331 and 334 are active, then a current $I_{va}$ in proportion to the analog speech signal $I_{vo}$ flows out from the first output terminal $O_{va}$ and a current $I_{vb}$ equal to the current $I_{va}$ flows in from the second output terminal $O_{vb}$. On the contrary, when in the negative half-cycle state, the second and third switched current sources 332 and 333 are active, then a current $I_{vb}$ in proportion to the analog speech signal $I_{vo}$ flows out from the second output terminal $O_{vb}$ and a current $I_{va}$ equal to the current $I_{vb}$ flows in from the first output terminal $O_{va}$. The current waveforms of the switched current sources 331, 332, 333 and 334 are shown in FIG. 7(A), and the current waveforms of the first and second output terminals $O_{va}$ and $O_{vb}$ are shown in FIG. 7(B).

In reference to FIG. 3, the comparison unit 34 is used to compare voltages of the first and second connected output terminals $O_a$ and $O_b$ so as to send out control signals $S_1$ and $S_2$. The relationships between the voltages and currents of the first and second connected output terminals and the control signals $S_1$ and $S_2$ are listed in Table 1 under the assumption that two current switch units 33 are connected to each other, in which $I_{na}=I_{va1}+I_{va2}$.

TABLE 1

| Input conditions | Output currents (voltages) | Control signals |
|---|---|---|
| $I_{va1} > 0$, $I_{va2} > 0$ | $I_{na} > 0$ ($V_{na} > V_{nb}$) | $S_1 = 1$, $S_2 = 0$ |
| $I_{va1} < 0$, $I_{va2} < 0$ | $I_{na} < 0$ ($V_{na} < V_{nb}$) | $S_1 = 0$, $S_2 = 1$ |
| $I_{va1} > 0$, $I_{va2} < 0$ | (a) $I_{na} > 0$ ($V_{na} > V_{nb}$) | (a) $S_1 = 1$, $S_2 = 0$ |
| | (b) $I_{na} < 0$ ($V_{na} < V_{nb}$) | (b) $S_1 = 0$, $S_2 = 1$ |
| $I_{va1} < 0$, $I_{va2} > 0$ | (a) $I_{na} > 0$ ($V_{na} > V_{nb}$) | (a) $S_1 = 1$, $S_2 = 0$ |
| | (b) $I_{na} < 0$ ($V_{na} < V_{nb}$) | (b) $S_1 = 0$, $S_2 = 1$ |

Figure 8:
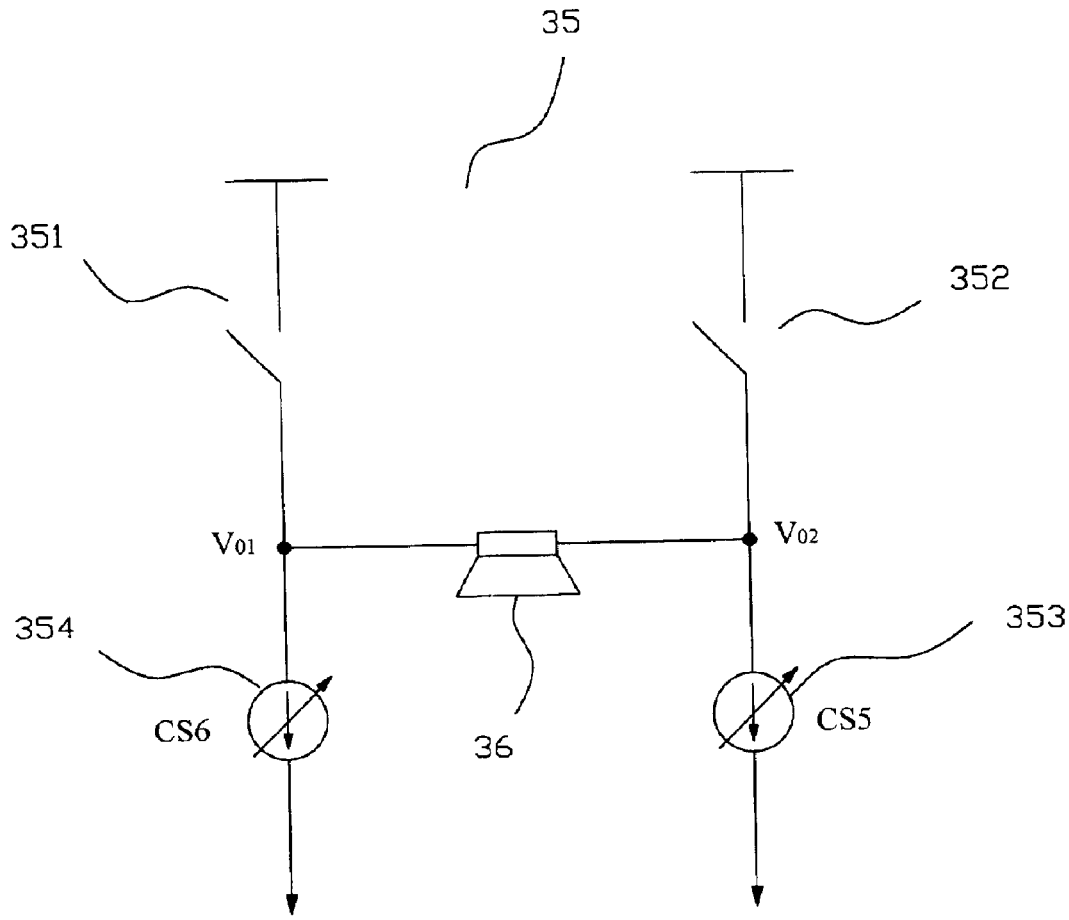
FIG. 8 is a control diagram for the current output unit shown in FIG. 3.

A control diagram for the current output unit 35 is shown in FIG. 8. The current output unit 35 includes control switches 351 and 352, and switched current sources 353 and 354, all of them are controlled by control signals $S_1$ and $S_2$. The current output unit 35 sends out a drive current to the speaker 36 from the first and second drive terminals $V_{o1}$ and $V_{o2}$. The current output unit 35 sends out the current in two modes, that is, when $S_1$=1 and $S_2$=0, the control switch 351 and switched current source 353 are conducted for the drive current to flow out from the first drive terminal $V_{o1}$ and flow in from the second drive terminal $V_{o2}$ through the speaker 36, and when $S_1$=0 and $S_2$=1, the control switch 352 and switched current source 354 are conducted for the drive current to flow out from the second drive terminal $V_{o2}$ and flow in from the first drive terminal $V_{o1}$ through the speaker 36. Thereby the current output unit 35 drives the speaker 36 with a push-pull type current output.

Figure 9:
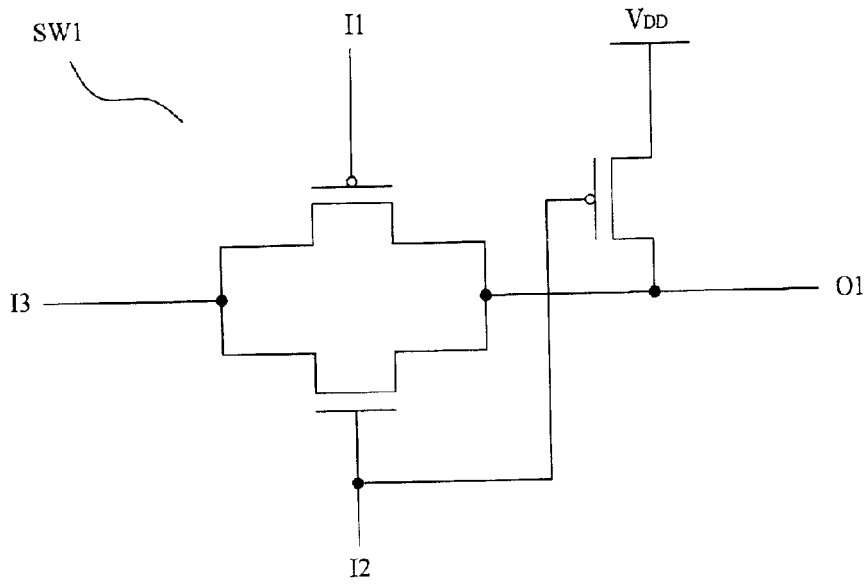
Figure 9:
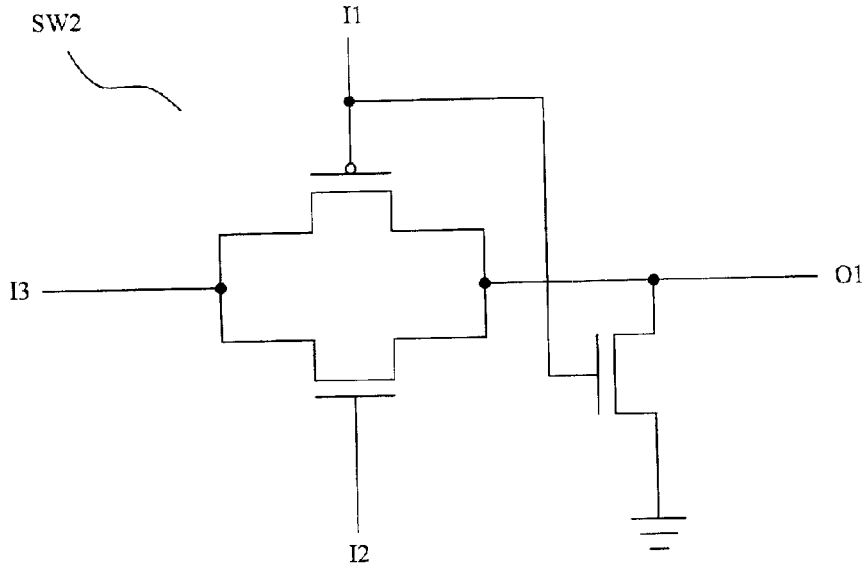

FIG. 9 shows the switch circuit diagrams applied to the present invention, in which FIG. 9(A) is the current output type switch and FIG. 9(B) is the current input type switch. As shown in FIG. 9(A), when the voltage of the first input terminal $I_1$ of the switch $SW_1$ is low and the voltage of the second input terminal $I_2$ of the switch $SW_1$ is high, the switch $SW_1$ is conductive and makes the third input terminal $I_3$ conducted to the output terminal $O_1$, otherwise the switch $SW_1$ is not conducted. In FIG. 9(B), when the voltage of the first input terminal $I_1$ of the switch SW2 is low and the voltage of the second input terminal $I_2$ of the switch $SW_2$ is high, the switch $SW_2$ is conductive and makes the third input terminal $I_3$ conducted to the output terminal $O_1$, otherwise the switch $SW_2$ is not conducted.

Figure 10:
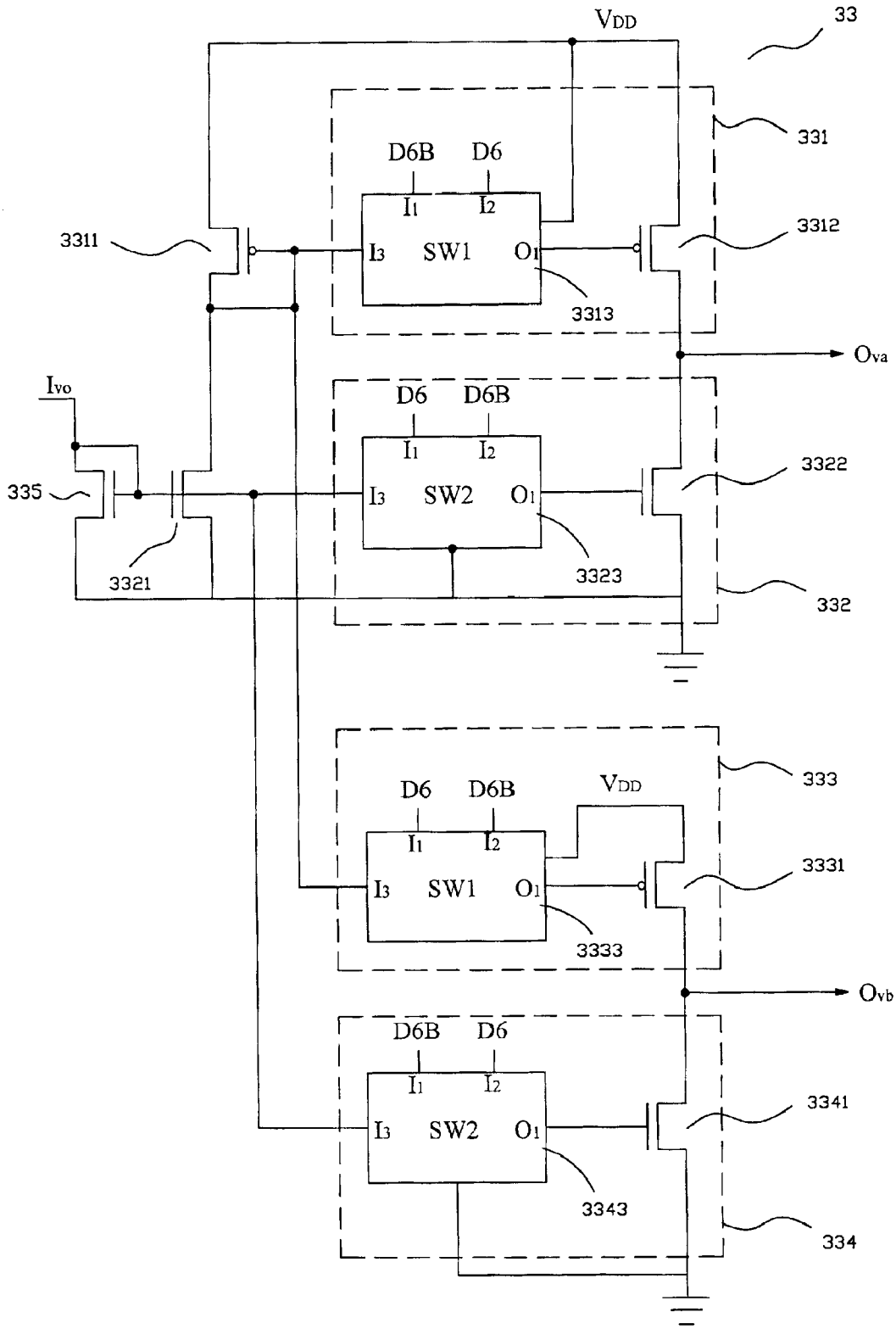
FIG. 10 is a circuit diagram for the current switch unit shown in FIG. 3.

A circuit diagram for the current switch unit 33 is shown in FIG. 10. The first switched current source 331 of the current switch unit 33 is controlled by $SW_1$ switch 3313, and a current mirror composed of transistors 3311 and 3312 is used to control the value of its output current. A current mirror composed of transistors 335 and 3321 receives the current $I_{vo}$ and its output is used for the input of the current mirror composed of transistors 3311 and 3312, thereby the switched current source 331 can send out a current that is proportional to the current $I_{vo}$. The first input $I_1$ of the switch 3313 is connected with D6B and the second input $I_2$ is connected with D6. The second switched current source 332 of the current switch unit 33 is controlled by $SW_2$ switch 3323, and a current mirror composed of transistors 335 and 3322 is used to control the value of its output current. The input of this current mirror is $I_{vo}$, thus the switched current source 332 can send out a current that is proportional to the current $I_{vo}$. The first input $I_1$ of the switch 3323 is connected with D6 and the second input $I_2$ is connected with D6B. The third switched current source 333 of the current switch unit 33 is controlled by $SW_1$ switch 3333, and a current mirror composed of transistors 3311 and 3331 is used to control the value of its output current. The input of this current mirror is the output of the current mirror composed of transistors 335 and 3321, thus the switched current source 333 can sent out a current that is proportional to the current $I_{vo}$. The first input $I_1$ of the switch 333 is connected with D6 and the second input $I_2$ is connected with D6B. The fourth switched current source 334 of the current switch unit 33 is controlled by $SW_2$ switch 3343, and a current mirror composed of transistors 335 and 3341 is used to control the value of its output current. The input of this current mirror is $I_{vo}$, thus the switched current source 332 can send out a current that is proportional to the current $I_{vo}$. The first input $I_1$ of the switch 3343 is connected with D6 and the second input $I_2$ is connected with D6B. When $I_{vo}$ is in the positive half-cycle, the voltage of D6 is high and that of D6B is low, the switches 3313 and 3343 are therefore conductive, and the current flows out from the first output terminal $O_{va}$ and flows in from the second output terminal $O_{vb}$. In contrast, when $I_{vo}$ is in the negative half-cycle, the voltage of D6 is low and that of D6B is high, the switches 3323 and 3333 are therefore conductive, and the current flows out from the first output terminal $O_{vb}$ and flows in from the second output terminal $O_{va}$.

Figure 11:
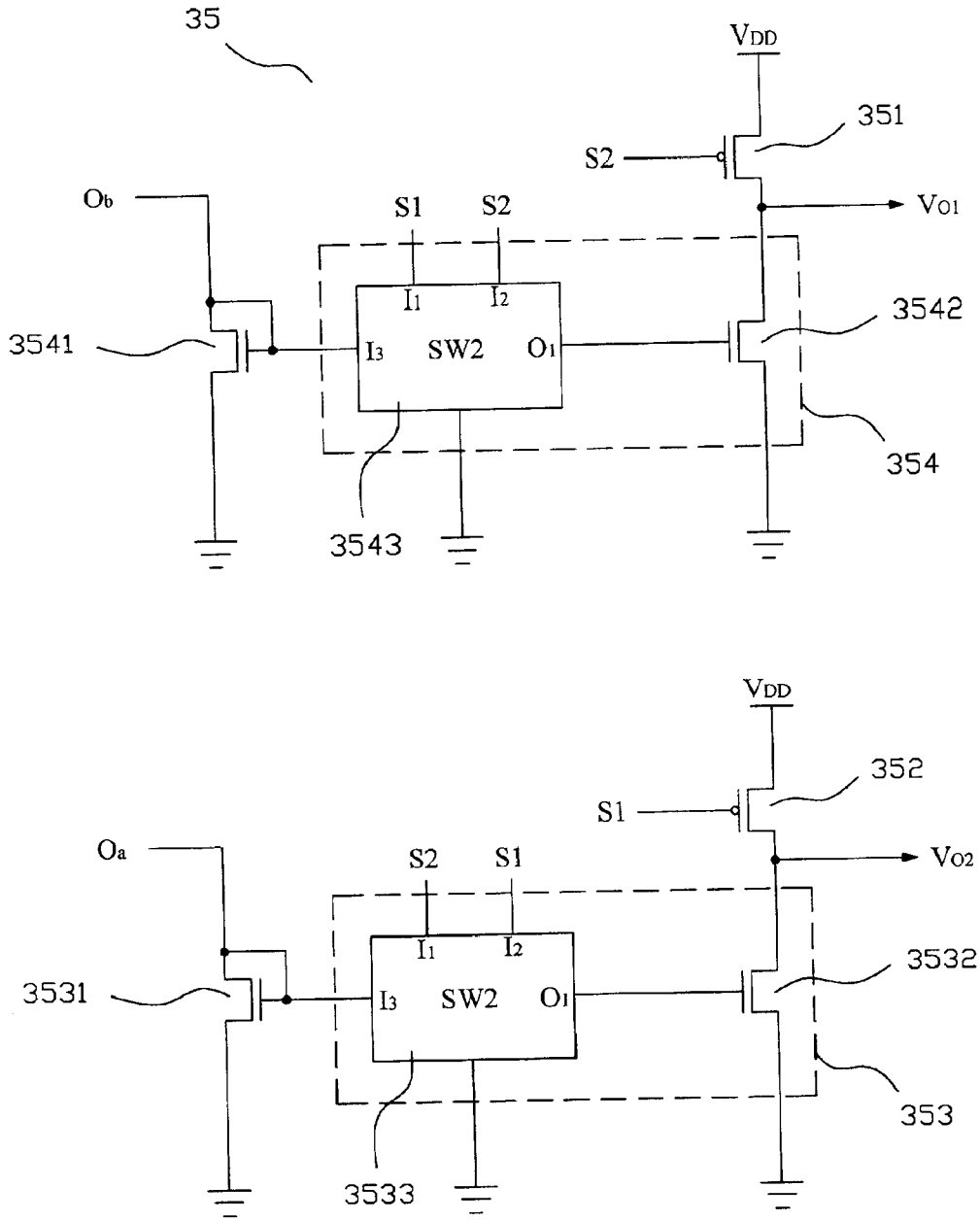
FIG. 11 is a circuit diagram for the current output unit shown in FIG. 3.

A circuit diagram for the current output unit 35 is shown in FIG. 11. The first control switch 351 and the second control switch 352 of the current output unit 35 are transistors with one terminal thereof connected with a power supply $V_{DD}$ and another terminal thereof connected with the switched current sources 353 and 354 respectively. The first control switch 351 is controlled by a control signal $S_1$, and the second control switch 352 is controlled by a control signal $S_2$. Furthermore, the input type switch 3533 controls the switched current source 353, and there is a current mirror composed of transistors 3531 and 3532. The first input of the switch 3533 is connected with the control signal $S_2$ and the second input is connected with the control signal $S_1$. The input type switch 3534 controls the switched current source 354, and there is a current mirror composed of transistors 3541 and 3542. The first input of the switch 3533 is connected with the control signal S1 and the second input is connected with the control signal S2.

The operations of the comparison unit 34 and current output unit 35 are described below. When the voltage $V_{na}$ of the first connected output terminal $O_a$ is higher than the voltage $V_{nb}$ of the second connected output terminal Ob, the current flows out from the first connected output terminal $O_a$, resulting in that the voltage $V_{na}$ rises, and the current flows in from the second connected output terminal $O_b$, resulting in that the voltage $V_{nb}$ falls. Meanwhile the voltage of $S_1$ is high and that of $S_2$ is low, so that the first control switch 351 of the current output unit 35 is conductive and the switched current source 353 is also conductive. The current passes the first control switch 351 and flows out from the first drive terminal $V_{o1}$ to drive the speaker 36 and flows in from the second drive terminal $V_{o2}$ and then grounded through the switched current source 353. When the voltage $V_{na}$ of the first connected output terminal $O_a$ is lower than the voltage $V_{nb}$ of the second connected output terminal $O_b$, the current flows out from the second connected output terminal $O_b$, resulting in that the voltage $V_{nb}$ rises, and then the current flows in from the first connected output terminal $O_a$, resulting in that the voltage $V_{na}$ falls. Meanwhile the voltage of $S_1$ is low and that of $S_2$ is high, so that the second control switch 352 of the current output unit 35 is conductive and the switched current source 354 is also conductive. The current passes the second control switch 352 and flows out from the second drive terminal $V_{o2}$ to drive the speaker 36, and flows in from the first drive terminal $V_{o1}$ and then grounded through the switched current source 354.

While the present invention has been described in conjunction with preferred embodiments thereof, it is evident that many alternatives, modifications and variations will be apparent to those skilled in the art. For example, in the embodiment the positions of the switch 351 and current source 353 can be exchanged. Accordingly, it is intended to embrace all such alternatives, modifications and variations that fall within the spirit and scope thereof as set forth in the appended claims.

What is claimed is:

1. A multi-track speech synthesizer comprising:

a plurality of signal transform units each for receiving a series of digital speech codes and converting them to an analog speech signal with a zero point at zero and its negative half-cycles inverted;

a plurality of current switch units each connected to said signal transform units respectively for receiving said analog speech signal from said signal transform units, each of said current switch units including first and second output terminals to send out a current for positive half-cycles of said analog speech signal from said first output terminal and back from said second output terminal and to send out a current for said negative half-cycles of said analog speech signal from said second output terminals and back from said first output terminal;

wherein said first output terminal of said current switch units are connected together to form a first connected output terminals;

wherein said second output terminal of said current switch units are connected together to form a second connected output terminal;

a comparison unit for comparing voltages of said first and second connected output terminals and then sending out a control signal; and a current output unit for receiving and sending out currents from said first and second connected output terminals from a first and second drive terminals under control of said control signal from said comparison unit.

2. A speech synthesizer according to claim 1 further comprising a plurality of volume control units each for receiving a control signal and producing a control bias to said signal transform units respectively.

3. A speech synthesizer according to claim 1 wherein each said signal transform unit controls a conversion of said digital speech codes by use of a most significant bit of each said digital speech codes.

4. A speech synthesizer according to claim 3 wherein each said signal transform unit comprises:

a switched buffer controlled by said most significant bit of said digital speech codes for receiving and sending a portion of the bits of said digital speech codes;

a switched inverter buffer controlled by said most significant bit of said digital speech codes for receiving a portion of the bits of said digital speech codes and sending out inversion of said a portion of the bits of said digital speech codes; and a digital/analog converter connected to said switched buffer and said switched inverter buffer for converting a received signal to said analog speech signal.

5. A speech synthesizer according to claim 3 wherein each said current switch unit comprises:

a first switched current source for sending out a current proportional to said analog speech signal to said first output terminal when said analog speech signal is in said positive half-cycle;

a second switched current source for supplying a current proportional to said analog speech signal to flow in from said first output terminal when said analog speech signal is in said negative half-cycle;

a third switched current source for supplying a current proportional to said analog speech signal to flow in from said second output terminal when said analog speech signal is in said positive half-cycle; and a fourth switched current source for sending out a current proportional to said analog speech signal to said second output terminal when said analog speech signal is in said negative half-cycle.

6. A speech synthesizer according to claim 3 wherein said current output unit comprises:

a first switch with a first terminal connected to said first drive terminal and a second terminal connected to a power supply, said first switch controlled by said control signal from said comparison unit to be conductive when said voltage of said first connected output terminal is higher than that of said second connected output terminal;

a second switch with a first terminal connected to said second drive terminal and a second terminal connected to a power supply, said second switch controlled by said control signal from said comparison unit to be conductive when said voltage of said second connected output terminal is higher than that of said first connected output terminal;

a fifth switched current source with a first terminal connected to said second drive terminal and a second terminal grounded, said fifth switched current source controlled by said control signal from said comparison unit to supply a current proportional to said current flowing in said second connected output terminal when said voltage of said first connected output terminal is higher than that of said second connected output terminal; and a sixth switched current source with a first terminal connected to said first drive terminal and a second terminal grounded, said sixth switched current source controlled by said control signal from said comparison unit to supply a current proportional to said current flowing in said first connected output terminal when said voltage of said second connected output terminal is higher than that of said first connected output terminal.

* * * * *